US006640378B2

(12) United States Patent
Hsu

(10) Patent No.: US 6,640,378 B2
(45) Date of Patent: Nov. 4, 2003

(54) TROWEL HAVING AN INTEGRAL AND COMFORTABLE HANDLE

(76) Inventor: Chiung Yueh Hsu, 7F, No. 46, Pin Ho 10 Street, Chang Hua (TW), 500

( * ) Notice: Subject to any disclaimer, the term of this patent is extended or adjusted under 35 U.S.C. 154(b) by 87 days.

(21) Appl. No.: 09/984,115

(22) Filed: Oct. 29, 2001

(65) Prior Publication Data

US 2003/0079306 A1 May 1, 2003

(51) Int. Cl.[7] ..... B05C 17/10

(52) U.S. Cl. ..... 15/235.4; 15/143.1; 16/430; 16/DIG. 18; 16/DIG. 19

(58) Field of Search ..... 15/143.1, 235.4–235.8, 15/245.1; 425/458; 81/489; 16/110.1, 421, 430, 436, DIG. 18, DIG. 19

(56) References Cited

U.S. PATENT DOCUMENTS

| | | | | | |
|---|---|---|---|---|---|
| 4,316,302 | A | * | 2/1982 | Clark | 15/235.4 |
| 4,884,312 | A | | 12/1989 | Clark | 15/235.4 |
| 5,327,612 | A | | 7/1994 | Kelsay | 15/235.4 |
| 5,781,956 | A | | 7/1998 | Kelsay et al. | 15/143.1 |
| 6,138,318 | A | * | 10/2000 | Pyatt et al. | 15/235.4 |
| 6,223,384 | B1 | * | 5/2001 | Kuhlen | 15/235.4 |

FOREIGN PATENT DOCUMENTS

| | | | | |
|---|---|---|---|---|
| DE | 1943110 | * | 5/1971 | 15/235.4 |
| DE | 3400819 | * | 7/1985 | 15/235.4 |
| FR | 2635998 | * | 3/1990 | 81/489 |

* cited by examiner

*Primary Examiner*—Mark Spisich

(57) ABSTRACT

A trowel includes a blade, a handle having two ends formed integral with the blade with such as a molding or a forging process. An outer cover is disposed on the outer peripheral portion of the handle by such as a molding process for allowing the users to comfortably grasp the handle. The ends of the handle are formed integral with two seats and two ramps of the blade, and each has one or more notches for receiving bulges of the outer cover and for solidly securing the outer cover onto the handle and for preventing the outer cover from moving relative to the handle.

1 Claim, 3 Drawing Sheets

TROWEL HAVING AN INTEGRAL AND COMFORTABLE HANDLE

BACKGROUND OF THE INVENTION

1. Field of the Invention

The present invention relates to a trowel, and more particularly to a trowel having an integral and comfortable handle.

2. Description of the Prior Art

Various kinds of typical trowels have been developed and used today. U.S. Pat. No. 4,884,312 to Clark discloses one of the trowels including a handle having one end secured onto a metal blade. The handle includes a hollow construction for weight reducing purposes. However, the handle has only one end secured to the metal blade, such that the handle may not be solidly secured onto the metal blade and may be easily disengaged from the metal blade after use.

U.S. Pat. No. 5,327,612 to Kelsay discloses the other typical trowel or tool including a metal blade having a shank and a handle tang extended from the metal blade, and a handle secured onto the handle tang. The handle also may not be solidly secured onto the handle tang and may be easily disengaged from the handle tang after use.

U.S. Pat. No. 5,781,956 to Kelsay et al. discloses a further typical trowel including a handle having one or two ends secured onto a metal blade. The handle includes a hollow construction for weight reducing purposes. However, the handle may also have a good chance to be disengaged from the metal blade after use and after the fasteners are disengaged from the handle and/or the metal blade.

The present invention has arisen to mitigate and/or obviate the afore-described disadvantages of the conventional trowels.

SUMMARY OF THE INVENTION

The primary objective of the present invention is to provide a trowel including an integral and comfortable handle.

In accordance with one aspect of the invention, there is provided a trowel comprising a blade, a handle including two ends formed integral with the blade and solidly secured to the blade, or formed as an integral one piece with the blade, and including an outer peripheral portion, and an outer cover disposed on the outer peripheral portion of the handle for allowing the users to comfortably hold or grasp the handle.

The blade includes a pair of seats extended upward therefrom, the ends of the handle are formed integral and secured to the seats of the blade.

The blade includes a pair of ramps provided and extended between the seats and the blade for reinforcing the seats.

The ends of the handle each includes at least one notch formed therein. The outer cover includes at least one protrusion extended inward therefrom and engaged into the notches of the handle for solidly securing the outer cover onto the handle and for preventing the outer cover from moving relative to the handle.

The handle includes at least one bulge extended outward therefrom, the outer cover includes at least one orifice formed therein for receiving the bulge of the handle and for solidly securing the outer cover onto the handle and for preventing the outer cover from moving relative to the handle.

The handle includes at least one groove formed therein for weight reducing purposes. The groove of the handle includes an open end, the handle includes a cap engaged onto the open end of the handle for blocking the open end of the handle, the cap is engaged between the handle and the outer cover.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
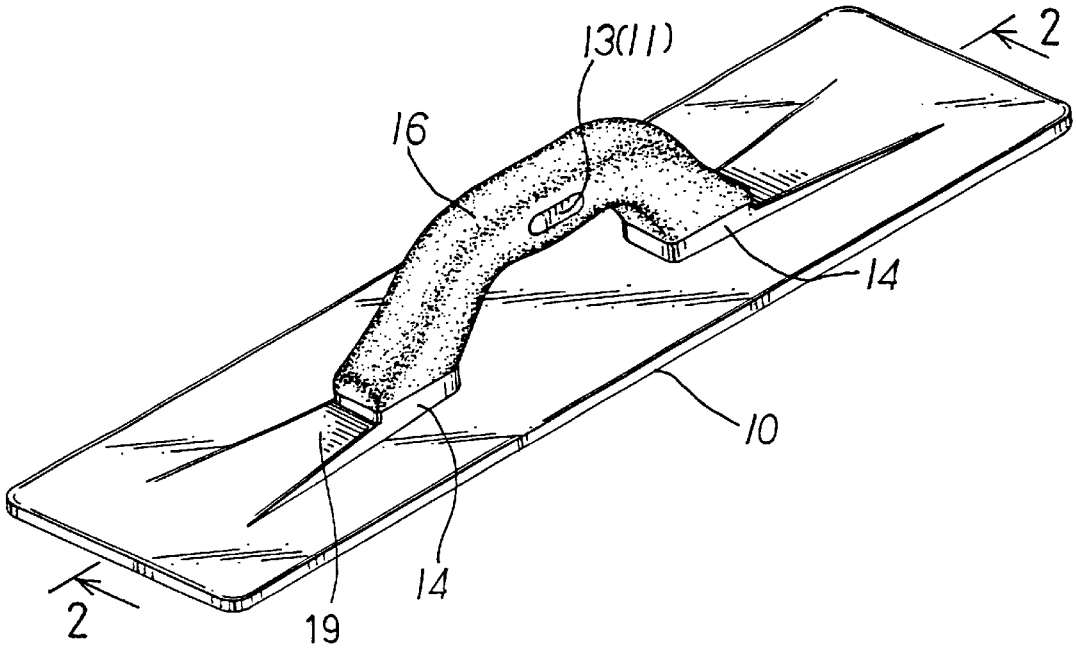
FIG. 1 is a perspective view of a trowel in accordance with the present invention.

Referring to the drawings, and initially to FIGS. 1–4, a trowel in accordance with the present invention comprises a blade 10, such as a metal blade 10, preferably made of magnesium and/or the alloys thereof, and a handle 11 provided or formed on top of the blade 10. For example, the blade 10 includes a pair of bulges or seats 14 formed or extended or provided on top thereof, and a pair of ramps 19 formed or provided between the seats 14 and the outer portions of the blade 10 for reinforcing the seats 14. The handle 11 includes two ends 17 formed integral on the seats 14 respectively and each having one or more notches or cut off portions, such as a pair of opposite notches 18 formed therein, for such as the weight reducing purposes.

Figure 2:
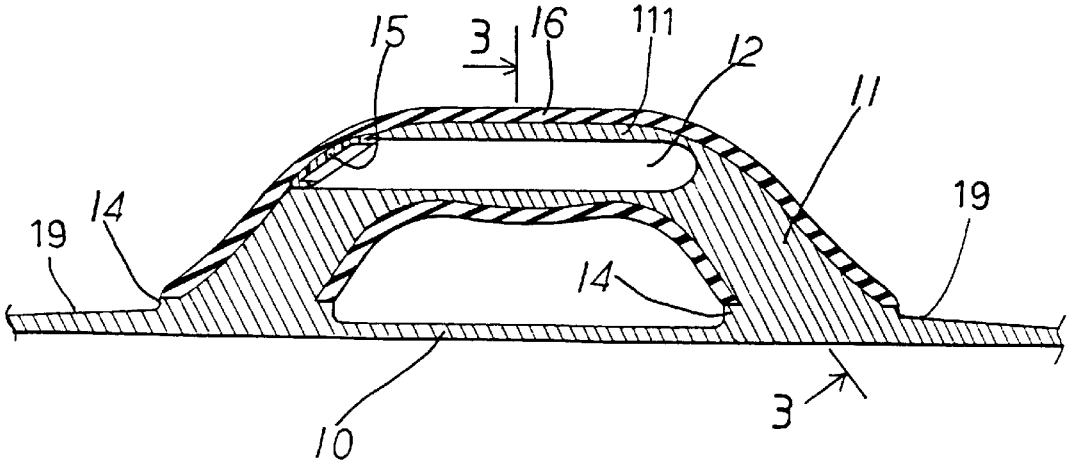
FIG. 2 is a partial cross sectional view taken along lines 2—2 of FIG. 1.
Figure 4:
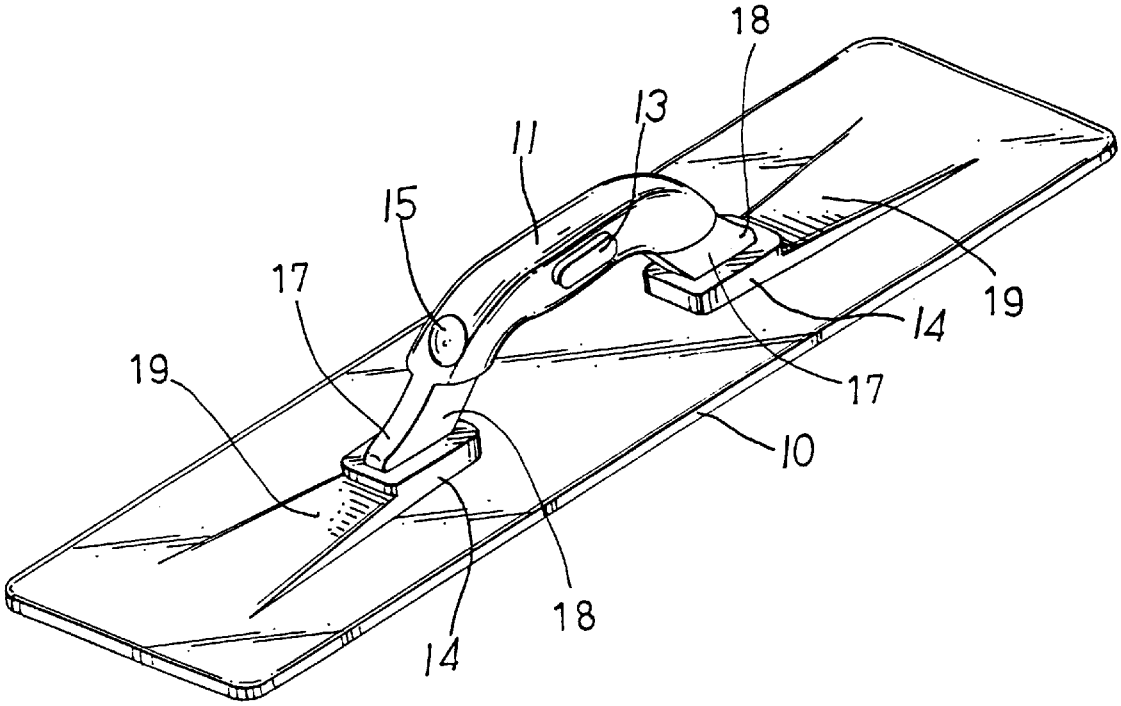
FIG. 4 is a perspective view of the trowel, in which the soft or the resilient sleeve or outer cover has been removed from the trowel for-showing the inner structure of the trowel.
Figure 3:
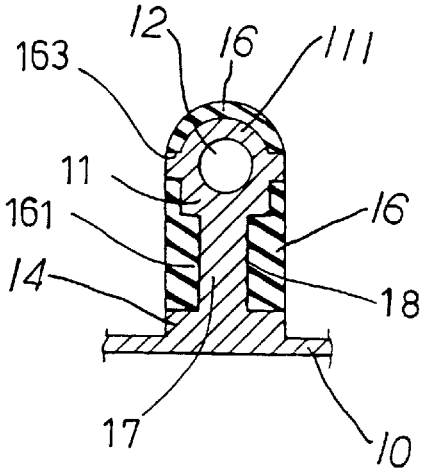
FIG. 3 is a partial cross sectional view taken along lines 3—3 of FIG. 2.
Figure 6:
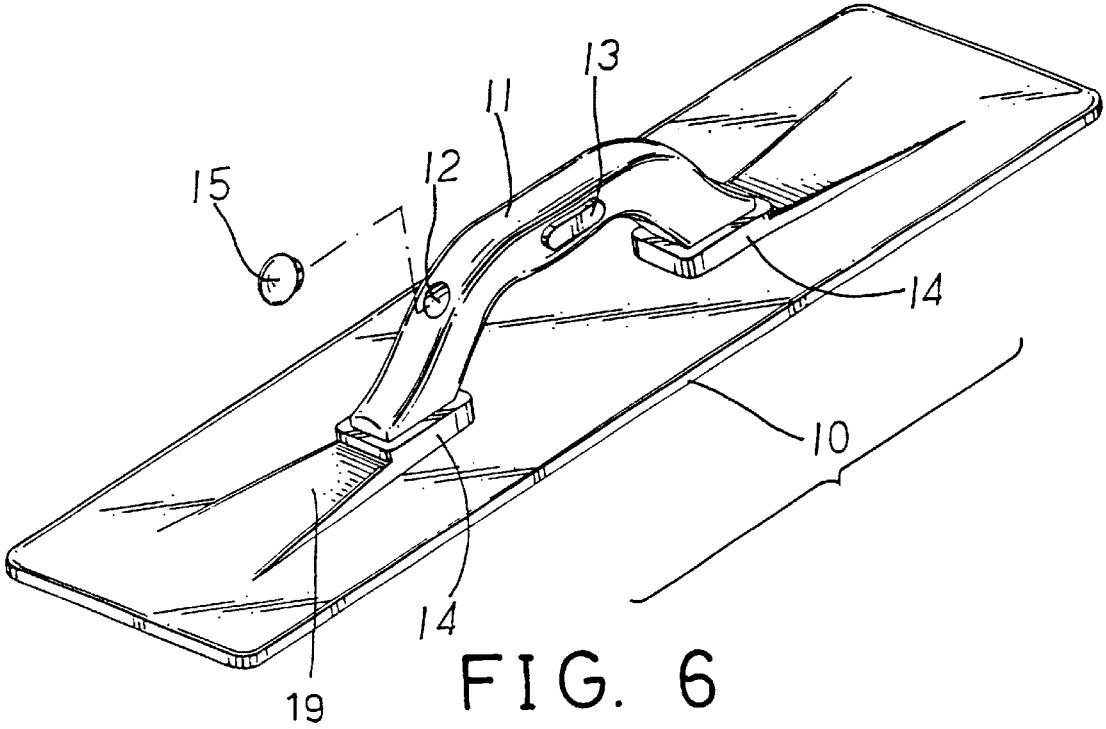
FIG. 6 is a partial exploded view of the trowel as shown in FIG. 5.
Figure 5:
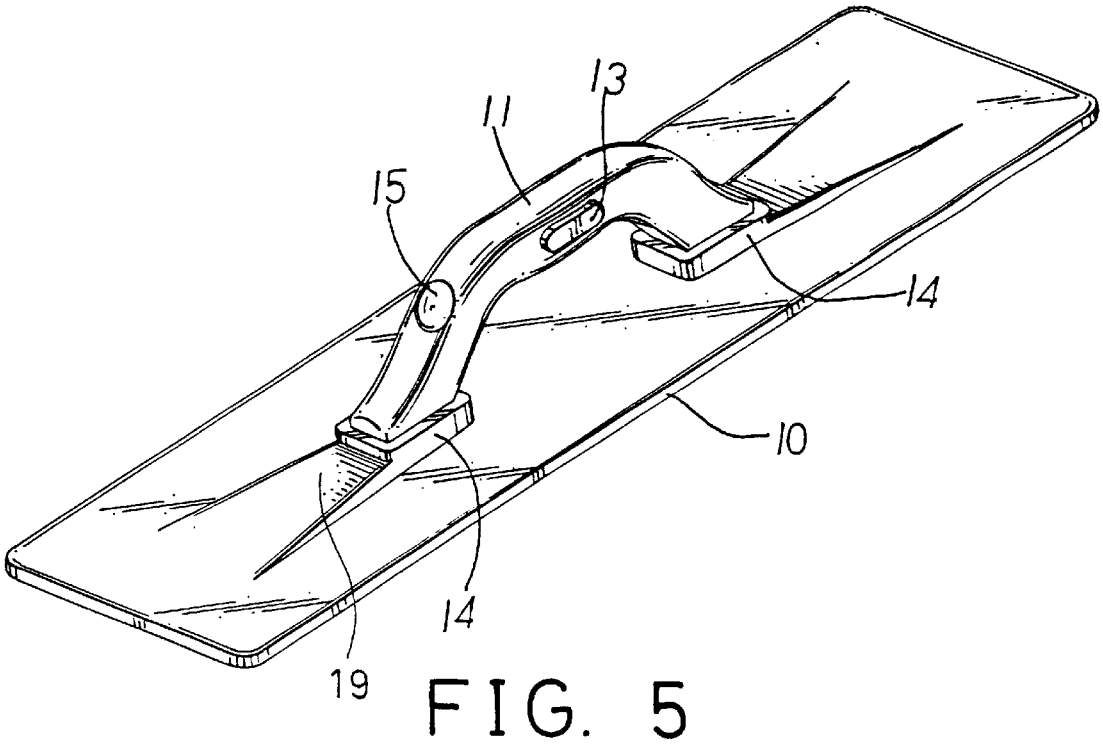
FIG. 5 is a perspective view of the trowel, similar to FIG. 4, illustrating the other embodiment of the trowel.

As best shown in FIGS. 2 and 3, the handle 11 includes a longitudinal or a horizontal or an upper portion or a middle portion Ill having a blind hole or a groove 12 formed therein for such as the weight reducing purposes. The groove 12 of the handle 11 includes a blind end and an open end. A cap 15 may be engaged onto the open end of the groove 12 of the handle 11 for blocking the groove 12 of the handle 11, and is also shown in FIGS. 5 and 6. The handle 11 includes one or more bulges 13 extended outward therefrom, such as laterally extended outward therefrom, onto which the trademark or the other information may be applied. The handle 11 and the metal blade 10 may be formed integral with each other in a molding process, a forging process, or the like.

A soft and/or resilient sleeve or an outer cover 16 may further be provided and attached or disposed onto the outer peripheral portion of the handle 11, with such as a molding process, and may be made of gel, rubber, foamable, spongy materials, or the like, for allowing the users to comfortably hold and grasp the handle 11 of the trowel. The cap 15 is preferably engaged onto the open end of the groove 12 of the handle 11 before the outer cover 16 is engaged or provided onto the handle 11, for allowing the cap 15 to be solidly retained in place, best shown in FIG. 2.

The outer cover 16 includes one or more protrusions 161 extended inward therefrom (FIG. 3) and engaged or molded into the notches 18 of the handle 11, for allowing the outer cover 16 to be solidly secured onto the handle 11 and for preventing the outer cover 16 from rotating or moving relative to the handle 11. The outer cover 16 further includes one or more orifices 163 formed therein (FIG. 3) for receiving the bulges 13 of the handle 11, and for further allowing the outer cover 16 to be solidly secured onto the handle 11 and for further preventing the outer cover 16 from rotating or moving relative to the handle 11. The bulges 13 of the handle 11 preferably flush with the outer surface of the outer cover 16, best shown in FIG.

Referring next to FIGS. 5 and 6, without the provision or the formation of the notches 18 in the handle 11, the outer cover 16 (FIGS. 1–3) may also be solidly engaged onto the handle 11 with the molding process, and may also include an engagement of the bulges 13 of the handle 11 in the orifices 163 (FIG. 3) of the outer cover 16, such that the outer cover 16 may also be solidly secured onto the handle 11 and may also be prevented from rotating or moving relative to the handle 11.

It is to be noted that the handle 11 includes two ends solidly formed or coupled to the metal blade 10 and formed as an integral one piece with the metal blade 10, such that the handle 11 may be solidly secured to the metal blade 10 and will not be disengaged from the metal blade 10. No further assembling processes are required for assembling the handle 11 onto the metal blade 10. In addition, the outer cover 16 may be solidly provided or applied or attached onto the handle 11 with the molding process, and will not be disengaged from the handle 11 after use.

Accordingly, the trowel in accordance with the present invention includes an integral and comfortable handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A trowel comprising:

a blade having an upper surface, a handle integrally formed with said blade and solidly secured thereto, said handle including an outer peripheral portion, said handle including a middle portion and two ends, said middle portion being spaced above said upper surface of said blade, said middle portion including at least one bulge extended outward therefrom, said two ends of said handle each including a pair of notches on opposite sides thereof such that each of the two ends has a width from adjacent the blade to a point adjacent the middle portion which is substantially less than the width of the middle portion, said middle portion further including an elongated groove having a blind end and an open end with said open end being adjacent one of said two ends, the open end being closed by a cap which is engaged with an inner surface of the groove; and an outer cover disposed on and molded over said outer peripheral portion of said handle, the material of said outer cover substantially covering the two ends and the middle portion of the handle, the outer cover including at least one orifice for receiving said at least one bulge of said handle and including a portion which protrudes into the notches of the two ends, whereby the outer cover is solidly secured onto said handle and prevented from moving relative thereto.

* * * * *